United States Patent [19]

Mayrhofer et al.

[11] 4,086,105

[45] Apr. 25, 1978

[54] METHOD OF PRODUCING FINE-GRAIN SHEET OR FINE-GRAIN PLATE OF AUSTENITIC STEELS

[75] Inventors: Max Mayrhofer; Walter Taschner, both of Linz, Austria

[73] Assignee: Vereinigte Osterreichische Eisen- und Stahlwerke - Alpine Montan Aktiengesellschaft, Vienna, Austria

[21] Appl. No.: 764,552

[22] Filed: Feb. 1, 1977

[30] Foreign Application Priority Data

Feb. 18, 1976 Austria ..... 1141/76

[51] Int. Cl.[2] ..... C21D 7/13

[52] U.S. Cl. ..... 148/12 R; 148/12 E

[58] Field of Search ..... 148/12 R, 12 F, 12 E

[56] References Cited

U.S. PATENT DOCUMENTS 3,849,209 11/1974 Ishizaki et al. ..... 148/12 F 3,865,636 2/1975 Suzuki et al. ..... 148/12 F 4,008,103 2/1977 Miyoshi et al. ..... 148/12 F

*Primary Examiner*—W. Stallard

*Attorney, Agent, or Firm*—Burns, Doane, Swecker & Mathis

[57] ABSTRACT

In a method of producing fine-grain sheet or plate, in particular fine-grain plate with a thickness of more than 50 mm, of austenitic steels by hot rolling billets or slabs in a number of passes, the mean velocity of the reduction in thickness ($v$ in mm/min) achieved in a plurality of subsequent passes in dependence upon the ferrite content ($f$ in %) of the steels is chosen in a manner that up to a ferrite content of 3.5%, the mean velocity of the reduction in thickness is more than 150 mm/min, and at a ferrite content of more than 3.5%, it is above a value given by the relationship $v = 3.8 f^2 - 60 f + 315$, the deformation carried out in this manner amounting to at least 30%.

8 Claims, 3 Drawing Figures v [mm/min]
300
250
200
150
130
100
80
50
3
2
4
7,9
3
3,5
4
5
6
7
8
f [Volums-%]

d [mm]
400
300
260
200
100
6
5'
7
5
0
1
2
3
4
t [min]

METHOD OF PRODUCING FINE-GRAIN SHEET OR FINE-GRAIN PLATE OF AUSTENITIC STEELS

The invention relates to a method of producing sheet or plate of austenitic steels with fine grain, in particular plate having a thickness exceeding 50 mm, by hot rolling ingots or slabs in a number of passes.

When producing austenitic plate having a thickness of more than 50 mm, coarse grain can form. The coarse grain regions cause fault indications when the plates are subjected to ultrasonic tests as are otherwise caused by faults, such as fissures or non-metallic inclusions, in the interior of the plate. Ultrasonic testing does not allow for a differentiation between coarse grain, which is not necessarily detrimental to the properties of use of austenitic plate, and interior faults which make it impossible to use the plate for certain purposes. Thus, the value of plate with coarse grain must be just as negatively assessed as that of plate with interior faults and it must be scrapped, in order to avoid the risk of using faulty plate for construction parts subjected to strong wear.

The invention aims to avoiding these disadvantages and difficulties and has as its object to provide a method of the above defined kind which makes it possible to produce austenitic plate with fine grain even at plate thicknesses exceeding 50 mm, so that faults or fault indications, respectively, caused by coarse grain are prevented. The plate produced according to the method of the invention is to have a maximum grain size of 3 according to ASTM, preferably of 4.

According to the invention, this object is achieved in that the mean velocity of the reduction in thickness, $v$ in mm/min, achieved in a plurality of subsequent passes is chosen in dependence upon the ferrite content $f$ in % of the steels, in a manner that up to a ferrite content of 3.5% the mean velocity of the reduction in thickness is more than 150 mm/min, preferably more than 200 mm/min and that above a ferrite content of 3.5% the mean velocity of the reduction in thickness is above the value given by the relationship $v = 3.8f^2 - 60f + 315$ (curve path 2, FIG. 2), preferably above the value given by the relationship $v = 3.8f^2 - 60f + 365$ (curve path 3, FIG. 2), the deformation carried out in this manner amounting to at least 30%. The ferrite content can be given in %-by-volume or in %-by-weight; the slight difference between %-by-volume and %-by-weight can be neglected.

The invention is based on the new finding that for the occurrence of a uniformly finely grained structure in thick plates of austenitic steel neither the overall deformation nor the reduction in thickness per pass is of primary importance, and that also the maintenance of certain deformation and final rolling temperatures is not of primary importance as has been thought so far (see, e.g., "Handbuch der Sonderstahlkunde" by E. Houdremont, Springer-Verlag, Heidelberg, Verlag Stahleisen mbH, Dusseldorf, 1956, pages 864 and 865).

Advantageously, the deformation carried out in dependence upon the ferrite content according to the invention, amounts to at least 50%.

For obtaining very fine grain it has proved especially effective, if after the passes carried out in dependence upon the ferrite content, only passes for adjusting a precise measure have been carried out.

In rolling processes with simultaneous repeated heating the deformation carried out in dependence upon the ferrite content suitably is carried out after the last heating-up.

The method according to the invention is carried out in a manner that at first the ferrite content of the ingot to be rolled is determined. This can be done on the basis of the known Schaeffler-diagram or in some other manner, e.g. according to magnetic processes. On the basis of the ferrite content determined, the minimum value of the mean velocity of the reduction in thickness is determined with the above mentioned relationship, and it is the best to use a diagram as help therefor. Thereupon the pass plan is determined while maintaining the mean velocity of the reduction in thickness.

This is illustrated in detail by way of an exemplary embodiment and with reference to the accompanying drawing, wherein.

In a 30-metric-ton converter an Ni-alloyed base melt was produced according to the oxygen-top-blowing method and vacuum-treated under decarburization in a degasing plant. To this base melt, the FeCr melted in two 6-metric-ton MF furnaces was alloyed in liquid form, and thereupon a second vacuum treatment was carried out for mixing it; the final adjustment of the analysis was carried out by adding ferro-alloys during the second vacuum-treatment. After the melt had been casted to two 15-metric-ton and one 17-metric-ton ingots, the following chemical composition was determined:

0.025% C
0.57% Si
1.36% Mn
18.63% Cr
9.63% Ni
0.49% Nb

The Cr-equivalent calculated from this analysis was found to be 19.73 by the formula given on the abscissa, and the Ni-equivalent was found to be 11.06 by the formula given on the ordinate.

Figure 1:
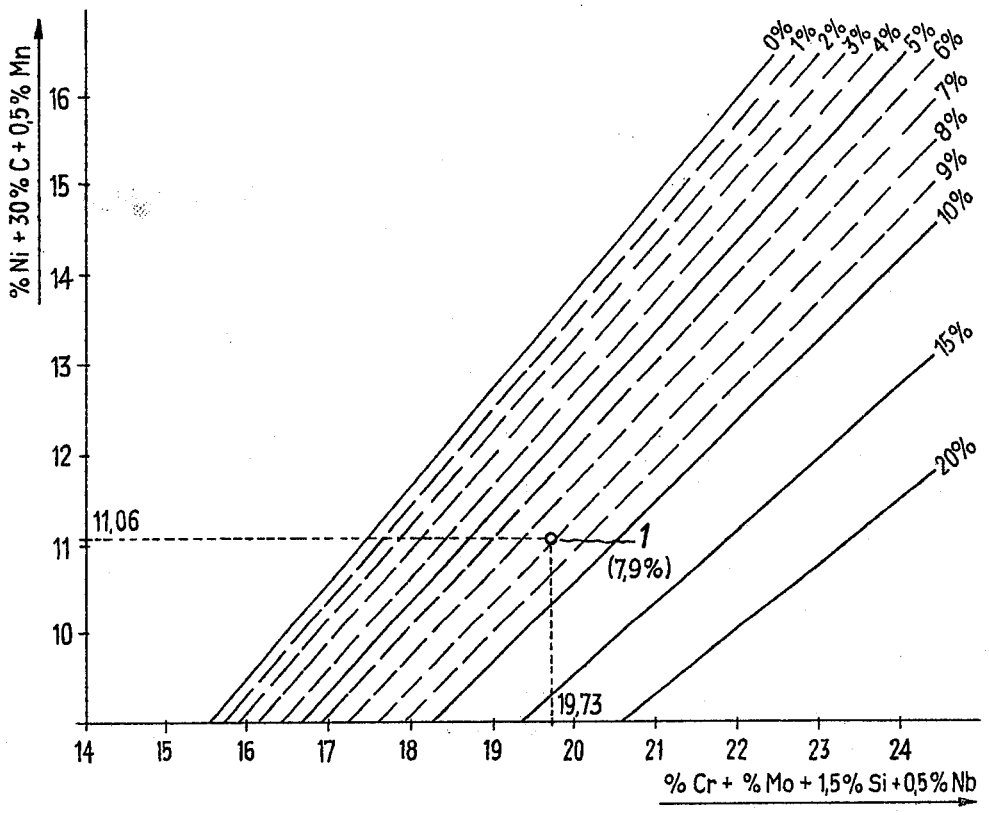
FIG. 1 is an excerpt of the Schaeffler-diagram.
Figure 2:
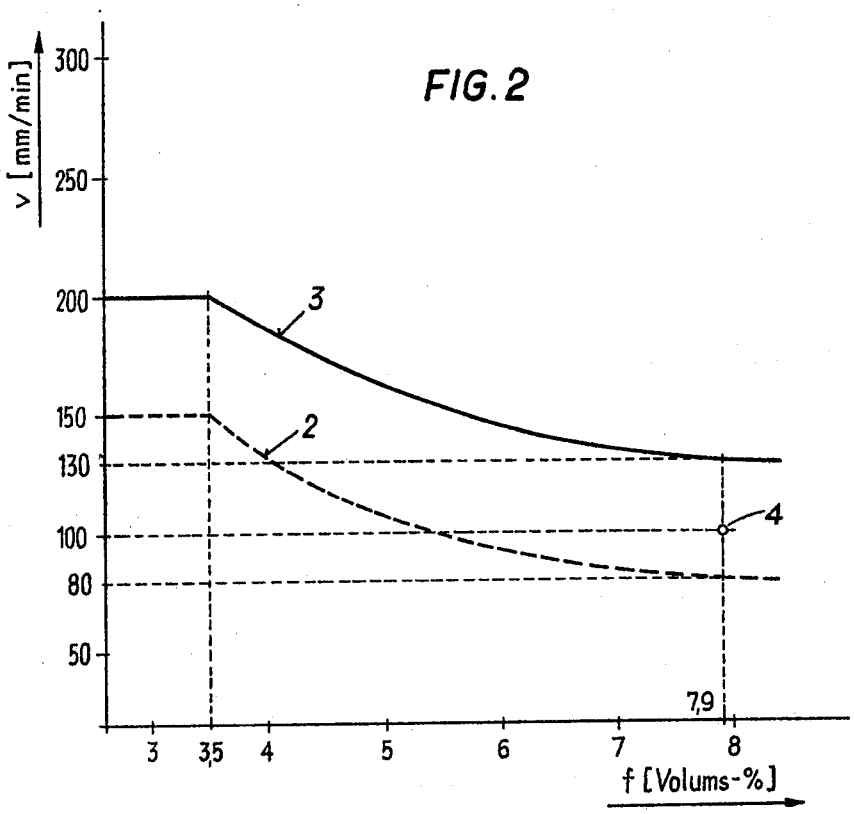
FIG. 2 illustrates the relationship between the ferrite content and the mean velocity of the reduction in thickness, on the knowing of which the invention is based.
Figure 3:
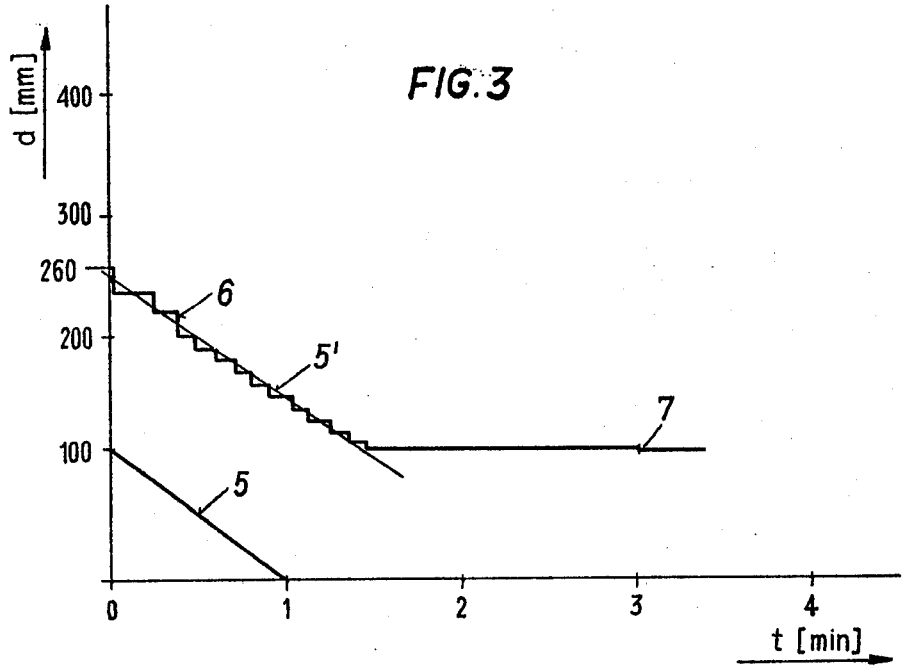
FIG. 3 shows the pass plan determined according to the invention.

From the intersection 1 in the Schaeffler-diagram there results a ferrite content of 7.9%-by-volume. This value of 7.9% is entered in the diagram according to FIG. 2, wherein the curve path 2 entered in broken lines indicates the lower limit of the mean velocity of the reduction in thickness in dependence upon the ferrite content $f$, at the exceeding of which coarse grain does not occur. Up to a ferrite content $f$ of 3.5% the curve path 2 entered in broken lines follows the straight line $v = 150$ mm/min, and starting at 3.5% ferrite, the parabola $v = 3.8f^2 - 60f + 315$ ($v$ in mm/min, $f$ in %-by-volume). The preferred relationship $v = 3.8f^2 - 60f + 365$ ($v$ in mm/min, $f$ in %-by-volume) is entered in FIG. 2 as curve 3, in full lines. Below a ferrite content of 3.5%, the path of the curve 3 follows the straight line $v = 200$ mm/min. From this there results that the mean velocity of the reduction in thickness must be at least approximately 80 mm/min and preferably at least approximately 130 mm/min in order to obtain plate having the desired fine grain structure according to the invention. In the present case, the mean velocity of the reduction in thickness was chosen to be 100 mm/min, which corresponds to point 4 in FIG. 2. The mean velocity of the reduction in thickness of 100 mm/min then was entered into the diagram according to FIG. 3 as straight line and parallelly displaced to 5′ up to a predetermined ingot thickness of 260 mm. This ingot thickness of 260 mm is obtained when the 17-metric ton ingot obtained after casting off, after a pit furnace heating at 1050° C is cogged on a four-high stand for plate having a nominal performance of 7000 KW to a thickness of 275 mm and subsequently is subjected to grinding.

The pass plan — as step-like curve 6 — is superimposed on the straight line 5′, each step corresponding to one pass. The cogged and ground slab was subdivided, heated to 1170° C in a pusher type furnace and rolled in accordance with the stepped curve 6 from 260 mm to 100 mm, corresponding to a deformation degree of 61.5%. During the rolling, a final rolling temperature of more than 1000° C was observed. The final pass 7 served for the precise measure adjustment of the final thickness desired. After the solution heat treatment at 1050° C and the quenching with water, the plate was subjected to ultrasonic testing. Fault indications could not be found. A micro-section was made over the entire thickness of the plate and grain size of approximately 6 according to ASTM was determined.

As indicated in the description, the essential feature of the present invention is the observance of minimum values of the mean velocity of the reduction in thickness relative to the ferrite content. The observance of the upper limit of the mean velocity of the reduction in thickness relative to the ferrite content is not critical, but the selection of a mean velocity of the reduction in thickness has an upper limit at approximately 300 mm/min due to the capacity of the rolling stands and the dimensions of the plate.

What we claim is:

1. In a method of producing fine-grain sheet or fine-grain plate of austenitic steels, in particular fine-grain plate having a thickness exceeding 50 mm, by hot rolling rolling stock in a number of passes, the improvement which is characterised in that the mean velocity of the reduction in thickness ($v$ in mm/min) achieved in a plurality of subsequent passes in dependence upon the ferrite content ($f$ in %) of the steels, is chosen in a manner that up to a ferrite content of 3.5% the mean velocity of the reduction in thickness is more than 150 mm/min and at a ferrite content of more than 3.5% the mean velocity of the reduction in thickness is above a value given by the relationship $v = 3.8f^2 - 60f + 315$, the deformation carried out in this manner amounting to at least 30%.

2. A method as set forth in claim 1, wherein said rolling stock is an ingot.

3. A method as set forth in claim 1, wherein said rolling stock is a slab.

4. A method as set forth in claim 1, wherein up to the ferrite content of 3.5% the mean velocity of the reduction in thickness is more than 200 mm/min.

5. A method as set forth in claim 1, wherein at a ferrite content of more than 3.5% the mean velocity of the reduction in thickness is above a value given by the relationship $v = 3.8f^2 - 60f + 365$.

6. A method as set forth in claim 1, wherein the rolling stock is deformed in dependence upon the ferrite content by at least 50%.

7. A method as set forth in claim 1, wherein passes carried out after the plurality of passes in dependence upon the ferrite content only serve for a precise measure adjustment.

8. A method as set forth in claim 1, wherein the rolling stock is rolled and simultaneously repeatedly heated up and wherein the rolling stock is deformed in dependence upon the ferrite content after it has been heated up for the last time.

* * * * *